US010779389B1

(12) United States Patent
Lee

(10) Patent No.: US 10,779,389 B1
(45) Date of Patent: Sep. 15, 2020

(54) HAND-TYPE LOW TEMPERATURE MICROWAVE PLASMA GENERATOR

(71) Applicant: PSM Inc., Gyeonggi-do (KR)

(72) Inventor: Keun-Ho Lee, Seoul (KR)

(73) Assignee: PSM Inc., Gyeonggi-do (KR)

( * ) Notice: Subject to any disclaimer, the term of this patent is extended or adjusted under 35 U.S.C. 154(b) by 0 days.

(21) Appl. No.: 16/790,323

(22) Filed: Feb. 13, 2020

(30) Foreign Application Priority Data

Jan. 20, 2020 (KR) ..... 10-2020-0007107

(51) Int. Cl.
*H05H 1/46* (2006.01)

(52) U.S. Cl.
CPC ..... *H05H 1/46* (2013.01); *H05H 2001/466* (2013.01); *H05H 2001/4607* (2013.01); *H05H 2245/1225* (2013.01)

(58) Field of Classification Search
CPC ..... H05H 1/46; H05H 2001/466; H05H 2245/1225; H05H 2001/4607
USPC ..... 315/111.21
See application file for complete search history.

(56) References Cited

U.S. PATENT DOCUMENTS 8,460,283 B1 * 6/2013 Laroussi ..... A61B 18/042 315/111.21
2009/0142514 A1 * 6/2009 O'Neill ..... H05H 1/46 427/595
2011/0301412 A1 12/2011 Cho
2012/0215158 A1 * 8/2012 Barthel ..... A61B 18/042 604/26
2016/0025656 A1 * 1/2016 Jevtic ..... H01J 49/10 324/633
2019/0046809 A1 * 2/2019 Kang ..... A61N 1/44

FOREIGN PATENT DOCUMENTS

KR 10-1189481 B1 10/2012
KR 10-1740821 B1 5/2017
KR 10-1940012 B1 1/2019
KR 10-2019-0035052 A 4/2019

* cited by examiner

*Primary Examiner* — Don P Le
(74) *Attorney, Agent, or Firm* — IP Legal Services, LLC

(57) ABSTRACT

Provided is a hand-type low temperature microwave plasma generator that is configured to implement plasma even in a low power state, and be easily applied to various small devices using microwave plasma including medical treatment and the like of wound treatment or cell treatment.

6 Claims, 4 Drawing Sheets

500 ; 510, 520

HAND-TYPE LOW TEMPERATURE MICROWAVE PLASMA GENERATOR

CROSS REFERENCE TO PRIOR APPLICATIONS

The present application claims priority under 35 U.S.C. § 119 to Korean Patent Application No. 10-2020-0007107 (filed on Jan. 20, 2020).

BACKGROUND

Field of the Invention

The present invention relates to a hand-type low temperature microwave plasma generator, and more particularly, to a hand-type low temperature microwave plasma generator that is configured to implement plasma even in a low power state, and be easily applied to various small devices using microwave plasma including medical treatment and the like of wound treatment or cell treatment.

Related Art

Plasma has been widely used in surface treatment and the like of semiconductors, display devices, and various parts, and its application has been expanded to become a convergent technology used in biotechnology research, medical care, air cleaning, incinerators, etc.

In other words, in general, a plasma generator is a device that separates gas molecules into cations and electrons between two electrodes when a high frequency or a high voltage is supplied to both electrodes, in which the two electrodes are installed in a vacuum state or in the air. Such plasma generator is applied to semiconductor, PCB, new material synthesis, polymer surface treatment, metal surface treatment, environmental purification, medical device, food sterilization and disinfection technology, etc., and its applications are expanding.

In particular, the plasma generator is expanding into medical fields such as teeth whitening, cancer cell death, and blood coagulation rate promotion. Lasers, which are mainly used in the related art, have the disadvantage of causing burns due to thermal damage and incapable of treating a large area due to a small laser radius. However, plasma has the advantages of no heat damage and uniformly and efficiently treating large treatment area by a plasma generator.

Ultraviolet (UV), oxygen radicals such as ozone, nitrogen oxides such as nitrogen monoxide, electric current and charged particles, which are generated in plasma, have each been reported to provide effects of increased cellular immunity, sterilization, cancer cell necrosis, and increased blood circulation.

As such, the plasma generator used for medical purposes requires stability because the plasma is directly irradiated to the human body.

For example, it is necessary to prevent an electric shock incident caused by leakage of a high voltage applied to generate a plasma. It is necessary to prevent damage to the human body by easily controlling plasma dosage, or easily control plasma emission to be used for surgery by increasing the plasma dosage to burn the necessary tissues.

In order for the user to easily handle the plasma generator, convenience and miniaturization of the plasma generator is required. In particular, miniaturization and easy control of the plasma emission are essential for applying the plasma generator to an endoscope.

However, in the case of the conventional plasma generator, insulation can be difficult because high voltage is required to generate plasma, and when a dielectric is a polymer containing fluorine or chlorine, serious side effects may be due to fluorine and chlorine generated during plasma generation.

In addition, there is a problem that the initiation of the initial discharge is very difficult to implement the plasma at low power for medical wound treatment and cell treatment

RELATED ART DOCUMENT

Patent Document (Patent Document 0001) Korea Patent Laid-Open Publication No. 10-2019-0035052 (published on Apr. 3, 2019)
(Patent Document 0002) Korean Patent No. 10-1740821 (Published on May 26, 2017)
(Patent Document 0003) Korean Patent No. 10-1940012 (Published on Jan. 18, 2019)
(Patent Document 0004) Korean Patent No. 10-1189481 (Published on Oct. 15, 2012)

SUMMARY

The present invention provides a hand-type low temperature microwave plasma generator that is configured to implement plasma even in a low power state, and be easily applied to various small devices using microwave plasma including medical treatment and the like of wound treatment or cell treatment.

The effects of the present disclosure are not limited to those mentioned above, and other effects not mentioned can be clearly understood by those skilled in the art from the following description.

In an aspect, a hand-type low temperature microwave plasma generator includes: a handpiece housing configured to have opened upper and lower portions and a predetermined cross-sectional shape; a microwave electrode tip configured to be connected to a microwave generator (M/G) and provided at an inner lower portion of the handpiece housing; a gas distribution member configured to be provided around the microwave electrode tip and supply externally provided plasma gas around the microwave electrode tip; a mounting housing configured to accommodate a lower portion of the handpiece housing and have a mounting hole on which the handpiece housing is mounted; and an ignition module configured to apply a high voltage pulse electric field to a lower portion of the microwave electrode tip in a state in which the handpiece housing is mounted on the mounting housing to initiate an initial plasma discharge.

The gas distribution member may include: a ring-shaped body part configured to be provided around the microwave electrode tip and have a cross-sectional ring shape formed as an insulator; and a plurality of gas distribution holes configured to be formed in the body part at intervals and formed to penetrate through the microwave electrode tip in parallel.

The mounting housing may be provided with a mounting hole on which the handpiece housing is mounted and may be formed in an enclosure shape in which the lower portion of the handpiece housing is accommodated through the mounting hole.

One of the handpiece housing and the mounting hole may be provided with one or more mounting protrusions, and the other of the handpiece housing and the mounting hole may be provided with a mounting groove where the mounting protrusion is seated.

The ignition module may include: a high voltage generator configured to be provided in the mounting housing to generate a high voltage; and a high voltage electrode tip configured to be provided on one side of the high voltage generator, provided to be opposite to the microwave electrode tip mounted on the mounting housing, and receive an electrical signal of the high voltage generator to emit a high voltage pulse electric field.

The hand-type low temperature microwave plasma generator may further include: an opposite position detection module configured to detect an opposite position of the high voltage electrode tip to the microwave electrode tip in a state in which the handpiece housing is mounted on the mounting housing.

The opposite position detection module may include: a detection unit configured to be provided on one side of the mounting housing; and a display unit configured to display a result detected by the detection unit.

DETAILED DESCRIPTION OF EMBODIMENTS

Figure 1:
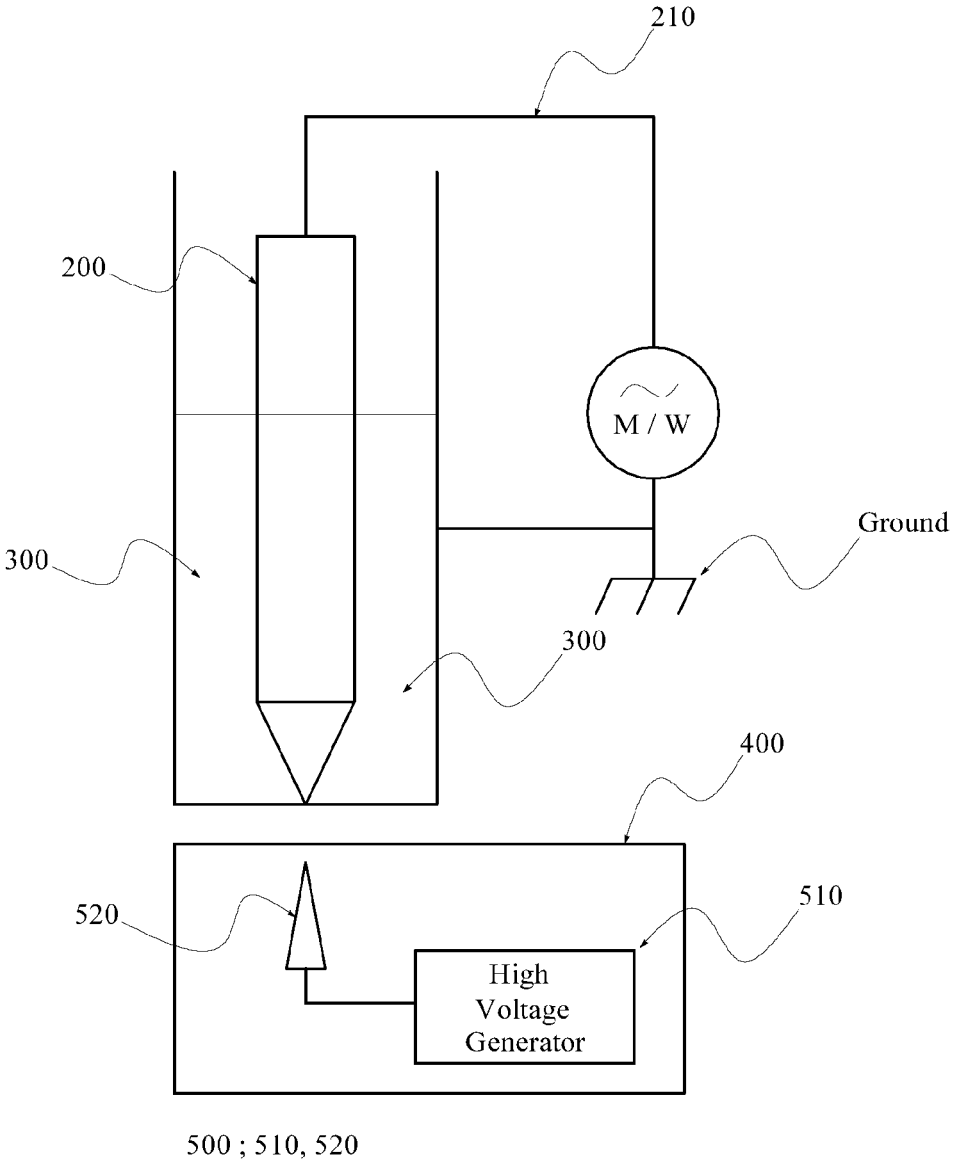
FIG. 1 is a conceptual diagram schematically showing blocks of components in order to explain a configuration of a hand-type low temperature microwave plasma generator according to the present invention.

Additional objects, features and advantages of the present invention may be more clearly understood from the following detailed description and the accompanying drawings.

Prior to the detailed description of the present invention, the present invention may be variously modified, and may have various embodiments, and the examples described below and illustrated in the drawings are intended to limit the present invention to specific embodiments, and it is to be understood that all changes, equivalents, and substitutes included in the spirit and scope of the present invention are included.

It is to be understood that when one element is referred to as being "connected to" or "coupled to" another element, it may be connected directly to or coupled directly to another element or be connected to or coupled to another element, having the other element intervening therebetween. On the other hand, it should be understood that when one element is referred to as being "connected directly to" or "coupled directly to" another element, it may be connected to or coupled to another element without the other element interposed therebetween.

Terms used in the present specification are used only in order to describe specific exemplary embodiments rather than limiting the present invention. Singular forms are intended to include plural forms unless the context clearly indicates otherwise. It should be further understood that terms "include" or "have" used in the present specification specify the presence of features, numerals, steps, operations, components, parts mentioned in the present specification, or combinations thereof, but do not preclude the presence or addition of one or more other features, numerals, steps, operations, components, parts, or combinations thereof.

A term "-er/or", "unit", "module", "block" or the like, described in the specification means a processing unit of at least one function or operation and may be implemented by hardware or software or a combination of hardware and software.

In addition, in the description with reference to the accompanying drawings, regardless of reference numerals, the same components will be given the same reference numerals and duplicate description thereof will be omitted. When it is decided that the detailed description of the known art related to the present invention may unnecessary obscure the gist of the present invention, a detailed description therefor will be omitted.

In addition, throughout this specification, when a step is located "on" or "before" with another step, not only the case in which a step is in direct time series relationship with another step, but also the case in which like a mixing step after each step, a step is in direct time series relationship in which a time series order in two steps may be reversed include the same rights.

Hereinafter, a hand-type low temperature microwave plasma generator according to a preferred embodiment of the present invention will be described in detail with reference to the accompanying drawings.

Figure 2:
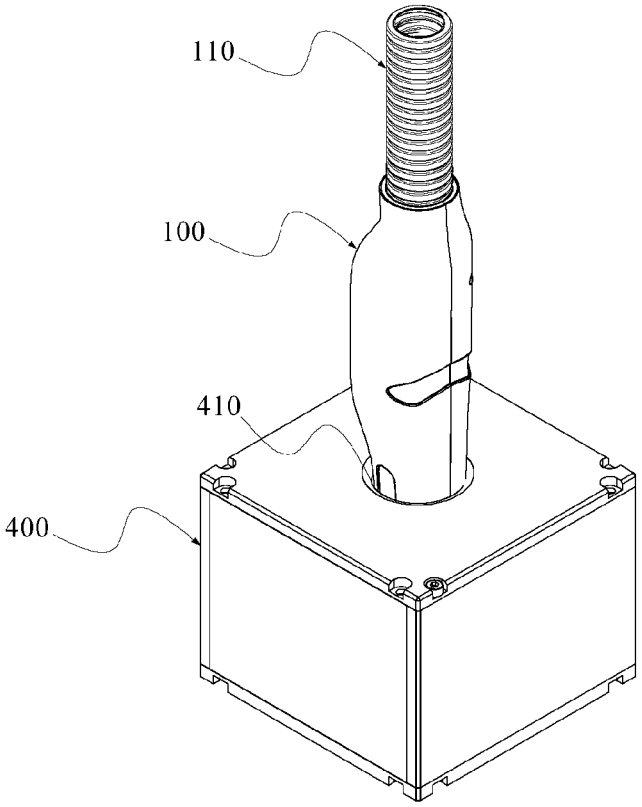
FIG. 2 is a perspective view showing an embodiment of the hand-type low temperature microwave plasma generator according to the present invention.
Figure 3:
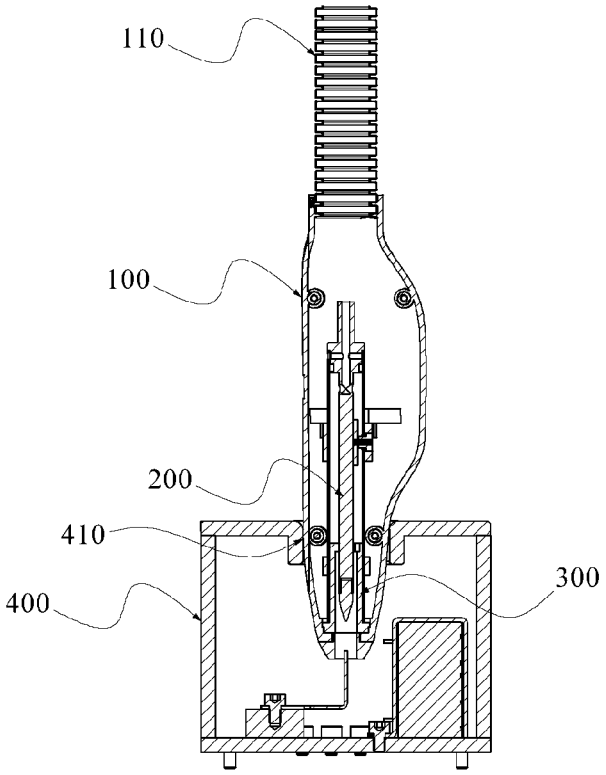
FIG. 3 is a longitudinal sectional view of FIG. 2 as a sectional view of an embodiment of a hand-type low temperature microwave plasma generator according to the present invention.
Figure 4:
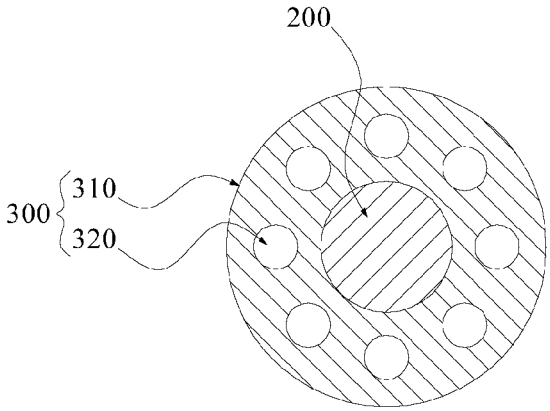
FIG. 4 is a plan view of a gas distribution member constituting the hand-type low temperature microwave plasma generator according to the present invention.
Figure 5:
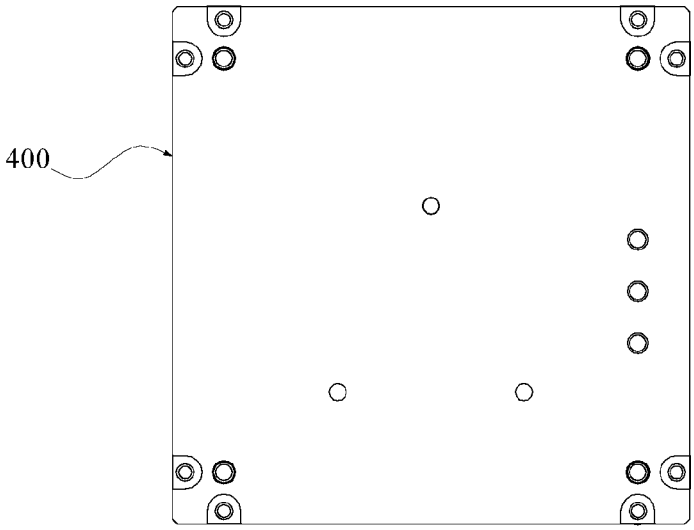
FIG. 5 is a rear view of a mounting housing constituting the hand-type low temperature microwave plasma generator according to the present invention.

FIG. 1 is a conceptual diagram schematically showing blocks of components in order to explain a configuration of a hand-type low temperature microwave plasma generator according to the present invention, FIG. 2 is a perspective view showing an embodiment of the hand-type low temperature microwave plasma generator according to the present invention, and FIG. 3 is a longitudinal sectional view of FIG. 2 as a sectional view of an embodiment of a hand-type low temperature microwave plasma generator according to the present invention. FIG. 4 is a plan view of a gas distribution member constituting the hand-type low temperature microwave plasma generator according to the present invention and FIG. 5 is a rear view of a mounting housing constituting the hand-type low temperature microwave plasma generator according to the present invention.

As shown in FIGS. 1 to 5, a hand-type low temperature microwave plasma generator according to the present invention is configured to largely include: a handpiece housing 100; a microwave electrode tip 200; gas distribution member 300; a mounting housing 400; and an ignition module 500.

Specifically, as shown in FIGS. 1 to 5, the hand-type low temperature microwave plasma generator according to the present invention includes: a handpiece housing 100 configured to have opened upper and lower portions and a predetermined cross-sectional shape; a microwave electrode tip 200 configured to be connected to a microwave generator (M/G) and provided at an inner lower portion of the handpiece housing 100; a gas distribution member 300 configured to be provided around the microwave electrode tip 200 and supply externally provided plasma gas around the microwave electrode tip 200; a mounting housing 400 configured to accommodate a lower portion of the handpiece housing 100, have a mounting hole 410 where the handpiece housing 100 is detached and seated, and have the handpiece housing 100 mounted thereon; and an ignition module 500 configured to be provided within the mounting housing 400 and apply a high voltage pulse electric field to a lower portion of the microwave electrode tip 200 to initiate an initial plasma discharge.

More specifically, the handpiece housing 100 is formed to be able to be gripped by a user, and has a shape in which the microwave electrode tip 200 and the gas distribution member 300 can be accommodated therein.

The handpiece housing 100 is configured to be grounded.

In addition, the handpiece housing 100 is configured so that the microwave electrode tip 200 is connected to the microwave generator (M/G) to guide a connection line 210 for providing an electrical signal of the microwave generator, and supplies gas to the gas distribution member 300.

In the implementation example illustrated in the drawings, the connection line 210 may be guided through a connector 110 configured at an upper end of the handpiece housing 100, and gas may be provided.

This handpiece housing 100 functions as a microwave plasma discharge port whose lower opening generates microwave plasma.

Next, the microwave electrode tip 200 has a lower end portion formed in a pointed end shape and is provided with the gas distribution member 300 to be described in detail below the lower portion.

In other words, the microwave electrode tip 200 may be formed as the known microwave electrode tip, but in the present invention, the lower portion of the microwave electrode tip 200 will be accommodated and mounted in the gas distribution member 300 to be described below.

Subsequently, the gas distribution member 300 is configured to distribute and supply plasma gas around the microwave electrode tip 200. As shown in FIG. 1, the gas distribution member may be configured to include a ring-shaped body part 310 that is provided around the microwave electrode tip 200 and has a cross-sectional ring shape formed as an insulator, and a plurality of gas distribution holes 320 that are formed in the body part 310, formed to penetrate through the microwave electrode tip 200 in parallel, and formed at intervals.

The ring-shaped body part 310 may be formed in the shape of a polygonal ring including a rectangular ring and the like as well as an annular ring shape.

When the electrical signal generated from the microwave generator (M/G) is applied to the microwave electrode tip 200, the gas distribution member 300 may effectively supply gas to the lower end portion of the microwave electrode tip 200 to implement plasma in a low power state and implement a role of an insulator for the microwave electrode tip 200.

Here, the handpiece housing 100 of the present invention may be provided with a controller (control means) that can control the amount of plasma gas discharged through the gas distribution member 300.

Next, the mounting housing 400 has a mounting hole 410 that accommodates the lower portion of the handpiece housing 100 and causes the handpiece housing 100 to be stably mounted, and is formed in an enclosure shape.

For example, the mounting hole 410 of the mounting housing 400 has a side that is formed in a shape corresponding to the outer surface of the handpiece housing 100 and may include a penetrating portion whose bottom is opened or a dome-shaped seating portion of the bottom opening.

In addition, one or more mounting protrusions are formed on a portion of an outer surface of the handpiece housing 100 so that the handpiece housing 100 can be stably mounted and held on the mounting hole 410 of the mounting housing 400, and a mounting groove where the mounting protrusion is seated may be formed on a wall surface of the mounting hole 410.

The mounting protrusion and the mounting groove may be formed in reverse. That is, one or more mounting grooves are formed on a portion of the outer surface of the handpiece housing 100 so that the handpiece housing 100 can be stably mounted and held on the mounting hole 410 of the mounting housing 400, and the mounting protrusion which is seated on the mounting groove may be formed on the wall surface of the mounting hole 410.

The mounting housing 400 has the ignition module 500 accommodated therein.

Next, the ignition module 500 is provided in the mounting housing 400, and is configured to apply a high voltage pulse electric field to the lower portion of the microwave electrode tip 200 to initiate an initial plasma discharge.

Specifically, the ignition module 500 is configured to include a high voltage generator 510 that is provided on one side of the mounting housing 400 to generate a high voltage, and a high voltage electrode tip 520 that is provided on one side of the high voltage generator 510, and provided to face the microwave electrode tip 200 mounted on the mounting housing 400, and receives an electrical signal of the high voltage generator 510 to emit a high voltage pulse electric field.

Here, as shown in the drawing, when the lower end portion of the handpiece housing 100 is formed to further extend below the microwave electrode tip 200, the handpiece housing 100 may be mounted on the mounting housing 400 so that a portion of the high voltage electrode tip 520 is inserted into the lower opening of the housing 100.

On the other hand, the hand-type low temperature microwave plasma generator according to the present invention may further include an opposite position detection module that detects the opposite position of the microwave electrode tip 200 to the high voltage electrode tip 520 in the state in which the handpiece housing 100 is mounted on the mounting housing 400, that is, the correct opposite position of the microwave electrode 200 to the high voltage electrode tip 520.

The opposite position detection module may be configured to include a detection unit such as an optical sensor that is provided on one side of the mounting housing 400 and a display unit (for example, red and green LEDs) that is provided on the other side of the mounting housing 400 to display results detected by the detection unit.

The opposite position detection module is configured to detect the mounting position of the handpiece housing 100 through the detection unit, and cause a user to recognize whether the handpiece housing 100 is mounted at the correct position through a light emitting color and the like on the display unit.

Accordingly, the user can operate the hand-type low temperature microwave plasma generator in the state in which the user can easily recognize whether the handpiece housing 100 is mounted at the correct position before generating an electric signal in the high voltage generator 510, that is, before applying the high voltage pulse electric field.

When the handpiece housing 100 including the microwave electrode tip 200 is mounted on the mounting hole 410 of the mounting housing 400, the ignition module 500 is configured to initiate the initial plasma discharge at the portion of the microwave electrode tip 200 by being applied with the high voltage pulse electric field from the high voltage electrode tip 520 as the electric signal of the high voltage generator 510 in the state in which the high voltage electrode tip 520 of the ignition module 500 is positioned opposite to the microwave electrode tip 200.

Accordingly, the present invention solves the difficulty of initiating the initial discharge by causing the ignition module 500 to implement plasma at low power.

The hand-type microwave plasma generator according to the present invention as described above can implement the plasma in the low power state at the electrode tip of the microwave generator to eliminate the need for high voltage applied to generate plasma so as to secure the stability, implement the plasma even in the low power state to be easily applied to various devices such as medical treatment devices for wound treatment or cell treatment, and promote the ease of use and miniaturization by being implemented at low power.

Although the embodiments as described above are described by a limited drawing, those skilled in the art may apply various technical modifications and variations based on the above. For example, even though the described techniques may be performed in a different order than the described method, and/or components of the described systems, structures, devices, circuits, etc. may be combined or combined in a different manner than the described method, or replaced or substituted by other components, appropriate results can be achieved.

The embodiments and the accompanying drawings described herein are merely illustrative of some of the technical ideas included in the present invention. Therefore, since the embodiments disclosed in the present specification are not intended to limit the technical spirit of the present invention but to describe the present invention, it is obvious that the scope of the technical idea of the present invention is not limited by these embodiments. Modifications and specific embodiments that can be easily inferred by those skilled in the art within the scope of the technical spirit included in the specification and drawings of the present invention should be construed as being included in the scope of the present invention.

According to the hand-type low temperature microwave plasma generator according to the present invention provides the following effects.

First, the present invention can implement the plasma in the low power state at the electrode tip of the microwave generator to eliminate the need for a high voltage applied to generate the plasma so as to secure the stability.

Second, the present invention can implement the plasma even in the low power state to be easily applied to various devices such as medical treatment devices for wound treatment or cell treatment.

Third, the present invention can promote the ease of use and miniaturization by being implemented at a low power.

The effects of the present disclosure are not limited to those mentioned above, and other effects not mentioned can be clearly understood by those skilled in the art from the following description.

What is claimed is:

1. A hand-type low temperature microwave plasma generator, comprising:

a handpiece housing configured to have opened upper and lower portions and a predetermined cross-sectional shape;

a microwave electrode tip configured to be connected to a microwave generator (M/G) and provided at an inner lower portion of the handpiece housing;

a gas distribution member configured to be provided around the microwave electrode tip and supply externally provided plasma gas around the microwave electrode tip;

a mounting housing configured to accommodate a lower portion of the handpiece housing and have a mounting hole on which the handpiece housing is mounted; and an ignition module configured to apply a high voltage pulse electric field to a lower portion of the microwave electrode tip in a state in which the handpiece housing is mounted on the mounting housing to initiate an initial plasma discharge, wherein the gas distribution member includes:

a ring-shaped body part configured to be provided around the microwave electrode tip and have a cross-sectional ring shape formed as an insulator; and a plurality of gas distribution holes configured to be formed in the body part at intervals and formed to penetrate through the microwave electrode tip in parallel.

2. The hand-type low temperature microwave plasma generator of claim 1, wherein the mounting housing is provided with a mounting hole on which the handpiece housing is mounted and is formed in an enclosure shape in which the lower portion of the handpiece housing is accommodated through the mounting hole.

3. The hand-type low temperature microwave plasma generator of claim 2, wherein one of the handpiece housing and the mounting hole is provided with one or more mounting protrusions, and the other of the handpiece housing and the mounting hole is provided with a mounting groove where the mounting protrusion is seated.

4. The hand-type low temperature microwave plasma generator of claim 1, wherein the ignition module includes:

a high voltage generator configured to be provided in the mounting housing to generate a high voltage; and a high voltage electrode tip configured to be provided on one side of the high voltage generator, provided to be opposite to the microwave electrode tip mounted on the mounting housing, and receive an electrical signal of the high voltage generator to emit a high voltage pulse electric field.

5. The hand-type low temperature microwave plasma generator of claim 1, further comprising:

an opposite position detection module configured to detect an opposite position of the high voltage electrode tip to the microwave electrode tip in a state in which the handpiece housing is mounted on the mounting housing.

6. The hand-type low temperature microwave plasma generator of claim 5, wherein the opposite position detection module includes:

a detection unit configured to be provided on one side of the mounting housing; and a display unit configured to display a result detected by the detection unit.

* * * * *